US007946230B2

(12) United States Patent
Serrano

(10) Patent No.: US 7,946,230 B2
(45) Date of Patent: May 24, 2011

(54) ANT RESISTANT DESSERT TABLE

(76) Inventor: Norman Serrano, San Dimas, CA (US)

( * ) Notice: Subject to any disclaimer, the term of this patent is extended or adjusted under 35 U.S.C. 154(b) by 142 days.

(21) Appl. No.: 12/422,782

(22) Filed: Apr. 13, 2009

(65) Prior Publication Data

US 2010/0258041 A1 Oct. 14, 2010

(51) Int. Cl.
*A47B 13/02* (2006.01)
*A01K 5/00* (2006.01)

(52) U.S. Cl. ..... 108/150; 119/61.53

(58) Field of Classification Search ..... 108/150, 108/24, 25, 26, 27, 161; 119/61.53, 61.1, 119/51.12, 51.5, 52.1
See application file for complete search history.

(56) References Cited

U.S. PATENT DOCUMENTS

| | | | | | |
|---|---|---|---|---|---|
| D105,812 | S | * | 8/1937 | Siekert | D30/130 |
| D127,800 | S | * | 6/1941 | Barrie | D26/10 |
| D190,668 | S | * | 6/1961 | Bliss | D7/557 |
| 3,176,676 | A | * | 4/1965 | Caldwell | 108/150 |
| 3,441,003 | A | | 4/1969 | Du Mond et al. | |
| 3,664,304 | A | * | 5/1972 | Carter | 119/61.5 |
| D269,386 | S | | 6/1983 | Khider | |
| 4,395,015 | A | * | 7/1983 | Reardon | 249/115 |
| 4,833,999 | A | * | 5/1989 | Rhoades | 108/150 |
| 4,953,506 | A | | 9/1990 | Sanders | |
| 4,966,099 | A | | 10/1990 | Arney | |
| 5,069,166 | A | * | 12/1991 | Ahuna | 119/61.53 |
| 5,113,798 | A | | 5/1992 | Rera | |
| 5,165,365 | A | | 11/1992 | Thompson | |
| 5,253,609 | A | | 10/1993 | Partelow et al. | |
| 5,372,063 | A | * | 12/1994 | Berg | 100/110 |
| D370,314 | S | * | 5/1996 | Pearson-Falcon | D30/130 |
| 6,065,428 | A | | 5/2000 | Fronk | |
| 6,125,790 | A | | 10/2000 | Breedwell | |
| 6,467,843 | B1 | * | 10/2002 | Rossborough | 108/150 |
| 6,520,114 | B1 | * | 2/2003 | Chun | 119/61.54 |
| 6,735,901 | B1 | | 5/2004 | Bellehumeur | |

* cited by examiner

*Primary Examiner* — José V Chen
(74) *Attorney, Agent, or Firm* — Kenneth L. Green

(57) ABSTRACT

A joint obstacle to ants is formed from two or more moats containing a liquid such as water, or a water dish soap mixture, spaced closely apart. The moats surround a table or serving plate for presenting dessert. The moats are separated by a short band about the same width as the moats. By spacing the moats closely apart, the ants rejects a path across the second moat, thereby preventing the ants from reaching the dessert.

17 Claims, 2 Drawing Sheets

ANT RESISTANT DESSERT TABLE

BACKGROUND OF THE INVENTION

The present invention relates to the control of ants and in particular to preventing ants from reaching desserts residing on a table.

Ants of various varieties are common in both rural and urban areas. In many areas, leaving a dessert remnant on a table, counter, or any location for a length of time, for example, overnight, results in an ant trail to the dessert remnant. Once the ants have found a dessert, they frequently return and quickly become a nuisance and are particularly annoying during hot, cold, or rainy weather when they are often actively seeking shelter. Ants may additionally create health issues. Ants also often spoil outdoor outings by invading dessert arranged on a picnic table or the like. Such invasions may be even more common in wet or other inclimate weather.

Various designs have been proposed to prevent access to bowls, tables, and the like to ants. Some simple designs include a single simple moat containing a liquid to block the ants, for example, U.S. Pat. No. 6,125,790, U.S. Pat. No. 5,165,365, U.S. Pat. No. 5,113,798, and U.S. Pat. No. 4,966,099. Unfortunately, a single moat has not proven effective to blocking ants. Other more complicated designs include two or more moats separated by various features in an attempt to block the ants, for example, U.S. Pat. No. 5,253,609, but these have amounted to disjoint obstacles which the ants have addressed as separate and independent obstacles and overcome as they have overcome a single moat.

Further, known designs are often delegated to utility bowls because of the awkward and/or overly complex appearance, for example, U.S. Pat. No. 5,253,609. Such designs are not acceptable for many occasions, for example, serving plates or table, where appearance is important.

Therefore, a need remains for an effective obstacle having an attractive design to prevent ants from reaching dessert.

BRIEF SUMMARY OF THE INVENTION

The present invention addresses the above and other needs by providing a joint obstacle to ants which is formed from two or more moats containing a liquid such as water, or a water and dish soap mixture, spaced closely apart. The moats surround a table or serving plate used for carrying dessert. The moats are separated by a short land about the same width as the moats. By spacing the moats closely apart, the ants reject a path across the second moat, thereby preventing the ants from reaching the dessert.

In accordance with one aspect of the invention, there is provided an ant resistant table. The ant resistant table includes a table top for carrying dessert and a base below the table top. The base includes a base bottom for residing on a horizontal surface, an outer edge of the base, a vertical support portion of the base providing support to the table top, and a horizontal top surface portion of the base between the outer edge and the vertical support portion and forming a closed path containing the vertical support portion. A joint obstacle resides on the horizontal top surface between the outer edge and the vertical support portion. The joint obstacle includes a first land, a first moat, a second land, and a second moat. The first land resides in the horizontal top surface portion against the outer edge and forms a closed path containing the vertical support portion and has a width of approximately ⅜ inches. The first moat resides in the horizontal top surface portion and inside and against the first land and forms a closed path containing the vertical support portion and has a width of approximately ⅜ inches. The second land resides on the horizontal top surface portion inside and against the first moat and forms a closed path containing the vertical support portion and has a width of approximately ⅜ inches. The second moat resides in the horizontal top surface portion and inside and against the second land and forms a closed path containing the vertical support portion and having a width of approximately ⅜ inches. The joint obstacle includes a combination of the first moat, the first land, and the second moat, and causes the ant to reject a path across the second moat.

In accordance with another aspect of the invention, there is provided an ant resistant table comprising an ant resistant pedestal serving plate. The ant resistant pedestal serving plate includes a table top, a base, and a pedestal. The table top is for carrying dessert and has a diameter of approximately ten inches. The base is below the table top and has a diameter of approximately six inches and includes: a base bottom for residing on a horizontal surface; an outer edge; a vertical support portion providing support to the table top; and a horizontal top surface portion between the outer edge and the vertical support portion and forming a closed path containing the vertical support portion. The pedestal extends upward from the vertical support portion and vertically supports the table top approximately six inches above the horizontal surface and is approximately 1.5 inches in diameter near the base and approximately one inch in diameter near the table top. The base further includes a joint obstacle including a combination of the first moat, the first land, and the second moat, and causes ants to reject a path across the second moat.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
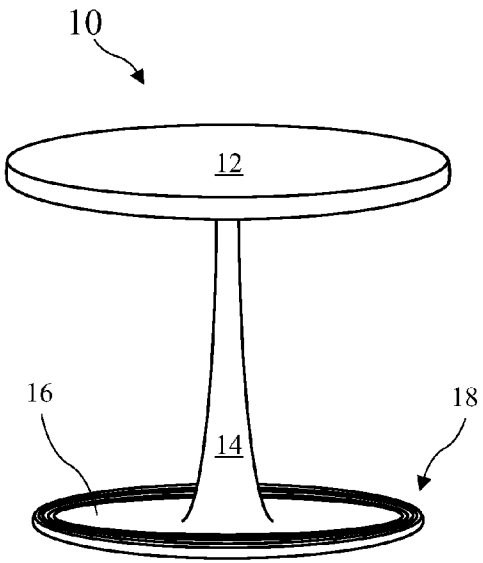
FIG. 1 is a side perspective view of an ant resistant table according to the present invention.
Figure 2B:
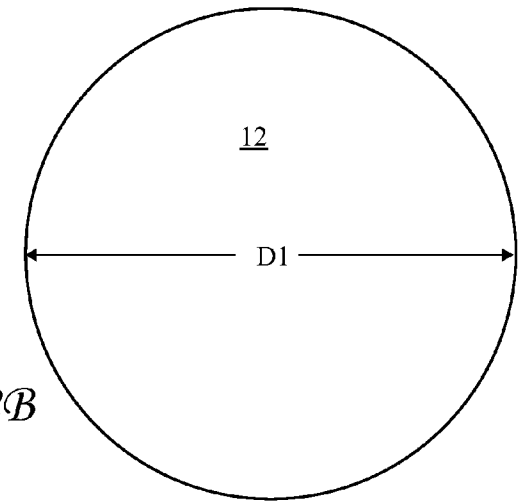
FIG. 2B is a top view of the ant resistant table according to the present invention.
Figure 2A:
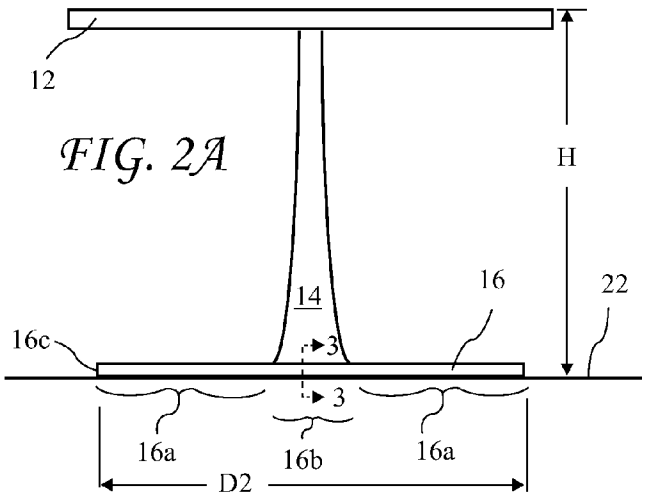
FIG. 2A is a side view of the ant resistant table according to the present invention.

A side perspective view of an ant resistant table 10 according to the present invention is shown in FIG. 1, a side view of the ant resistant table 10 is shown in FIG. 2A and a top view of the ant resistant table 10 is shown in FIG. 2B, The ant resistant table 10 includes a flat top 12 for carrying dessert, a base 16, and a pedestal 14. The base 16 resides on a horizontal surface 22 thereby supporting the pedestal 14 and top 12. The base 16 includes an outer edge 16*c*, a horizontal top surface portion 16*a* and a vertical support portion 16*b*. The horizontal top surface portion 16*a* resides between the outer edge 16*c* and the vertical support portion 16*b* and forms a closed path containing the vertical support portion 16*b* between the outer edge 16*c* and the vertical support portion 16*b*. The pedestal 14 attaches to the base 16 over the vertical support portion 16*b*. Thus, an ant, or other insect, must cross the horizontal top surface portion 16*a* to reach the pedestal 14. A joint obstacle 18 resides on or in the horizontal top surface portion 16*a* and forms closed path containing the vertical support portion 16*b* to prevent ants from reaching the pedestal 14 and top 12 of the table 10.

A common example of the ant resistant table 10 is a pedestal serving plate. Such pedestal serving plate commonly has a top diameter D1, a height H, and a base diameter D2. The diameters D1 and D2 are generally approximately ten inches and approximately six inches, and the height H is generally approximately six inches. The pedestal 14 is approximately 1½ inches in diameter near the base 16 and approximately one inch in diameter near the top 12.

Figure 3:
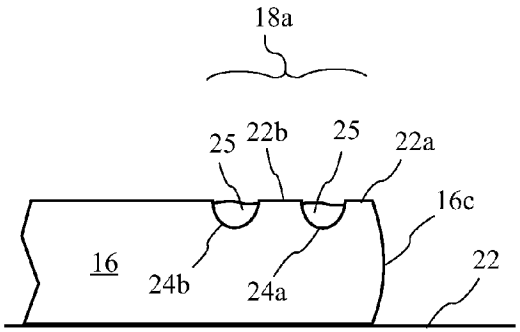
FIG. 3 is a cross-sectional view of a first embodiment of a joint obstacle on a base of the ant resistant table according to the present invention.

A cross-sectional view of a first embodiment of a joint obstacle 18*a* on the horizontal top surface portion 16*a* of the ant resistant table 10 is shown in FIG. 3. The joint obstacle 18*a* comprises a first land 22*a* next to and inside the outer edge 16*c* and forming a closed path, a first moat 24*a* containing a liquid 25 such as water, or a water and dish soap mixture, next to and inside the first land 22*a* and forming a closed path, a second land 22*b* next to and inside the first moat 24*a* and forming a closed path, and a second moat 24*b* containing the liquid 25, next to and inside the second land 22*b* and forming a closed path. The joint obstacle 18*a* is therefore inside the outer edge 16*c* and forms a closed path containing the vertical support portion 16*b* preventing ants from reaching the pedestal 14.

The joint obstacle 18*a* presents a combination of obstacles (the moats 24*a* and 24*b*), and by spacing the moats closely together, the ants reject a path across the second moat, thereby preventing the ants from reaching the dessert. Known ant resistant tables either include only a single moat which is not effective, or multiple obstacles which either are ineffective or create an unacceptable appearance. The present invention utilizes the inventor's discovery that ants reject a path across closely spaced moats. While the actual decision process executed by the ants is unknown, the ant decision process has been observed to reject attempting to cross a second moat immediately after crossing a first moat.

Figure 4:
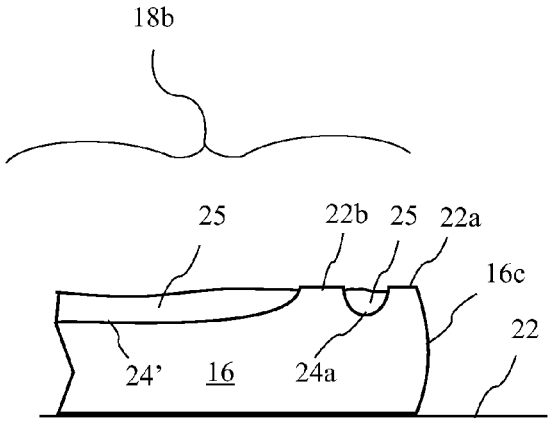
FIG. 4 is a cross-sectional view of a second embodiment of a joint obstacle on the base of the ant resistant table according to the present invention.

A cross-sectional view of a second embodiment a joint obstacle 18*b* according to the present invention is shown in FIG. 4. The joint obstacle 18*b* includes the first land 22*a*, first moat 24*a*, and the second land 22*b* as in the joint obstacle 18*a*, but the second moat 24*a* is replaced by a wide moat 24'. The wide moat 24' may extend partially inwards towards the vertical support portion 16*b* or all the way to the vertical support portion 16*b* and may provide a different appearance found attractive by some users.

Figure 5:
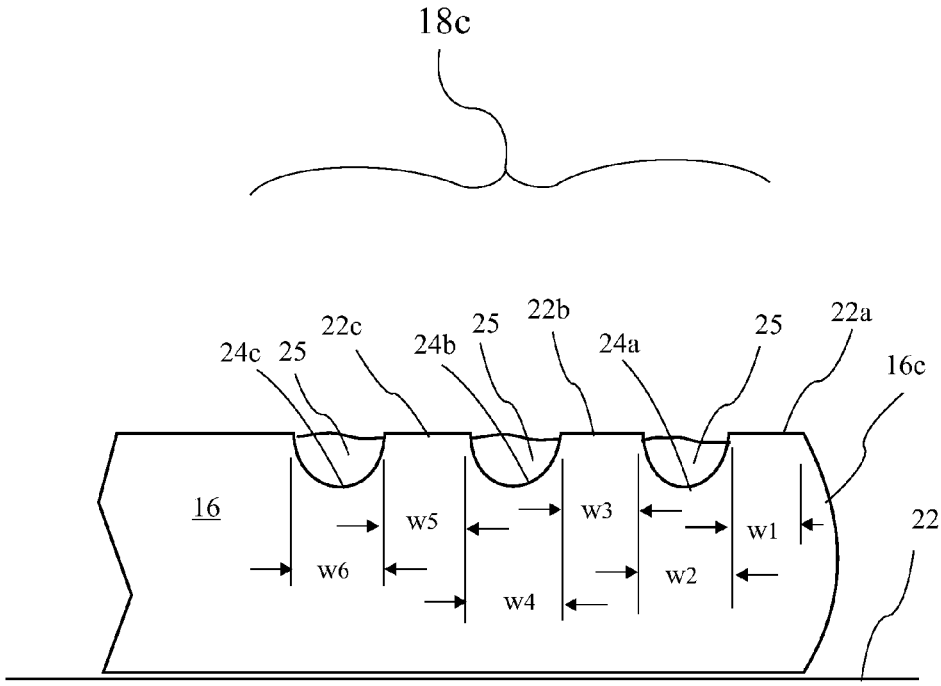
FIG. 5 is a cross-sectional view of a third embodiment of a joint obstacle on the base of the ant resistant table according to the present invention.

A cross-sectional view of a third embodiment a joint obstacle 18*c* according to the present invention is shown in FIG. 5. The joint obstacle 18*c* adds a third land 22*c* and a third moat 24*c* to the first obstacle 18*a*. The lands 22*a*, 22*b*, and 22*c* have widths w1, w3, and w5 respectively, and the moats 24*a*, 24*b*, and 24*c* have widths w2, w4, and w6 respectively. The widths w1-w6 are preferably approximately the same and are more preferably approximately ⅜ inches.

Figure 6:
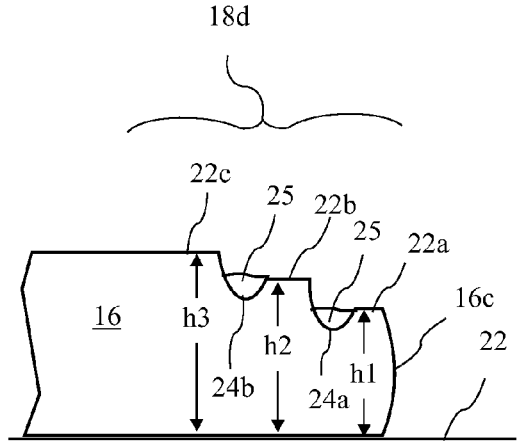
FIG. 6 is a cross-sectional view of a fourth embodiment of a joint obstacle on the base of the ant resistant table according to the present invention.

A cross-sectional view of a fourth embodiment a joint obstacle 18*d* according to the present invention is shown in FIG. 6. The joint obstacle 18*d* is similar to the joint obstacle 18*a*, but the lands 22*b* and 22*c* are progressively raised. The lands 22*a*, 22*b*, and 22*c* have heights h1, h2, and h3 above the horizontal plane 22, and are preferably approximately ½ inches, approximately ⅝ inches and approximately ¾ inches. Alternative, the land 22*b* is preferably approximately ⅛ inches higher than the land 22*a*, and the land 22*c* is preferably approximately ⅛ inch higher than the land 22*b*.

While the invention herein disclosed has been described by means of specific embodiments and applications thereof, numerous modifications and variations could be made thereto by those skilled in the art without departing from the scope of the invention set forth in the claims.

I claim:

1. An ant resistant table comprising:

a table top for carrying dessert;

a base below the table top, the base having a base bottom for residing on a horizontal surface;

an outer edge of the base;

a vertical support portion of the base providing support to the table top;

a horizontal top surface portion of the base between the outer edge and the vertical support portion and forming a closed path containing the vertical support portion;

a joint obstacle residing on the horizontal top surface between the outer edge and the vertical support portion, the joint obstacle comprising:

a first moat containing a liquid and residing in the horizontal top surface portion and residing in from the outer edge and forming a closed path containing the vertical support portion;

a second land residing on the horizontal top surface portion between the first moat and the vertical support portion and forming a closed path containing the vertical support portion; and a second moat containing the liquid and residing in the horizontal top surface portion and spaced in from the second land and forming a closed path containing the vertical support portion, wherein, the joint obstacle comprising the combination of the first moat, the second land, and the second moat, the first moat and the second land have approximately the same width, and the joint obstacle causes the ant to reject a path across the second moat.

2. The ant resistant table of claim 1, further including a pedestal extending upward from the vertical support portion of the base and vertically supporting the table top.

3. The ant resistant table of claim 2, wherein:

the table top has a diameter of approximately ten inches;

the base has a diameter of approximately six inches; and the pedestal lifts the table top approximately six inches above the horizontal surface.

4. The ant resistant table of claim 3, wherein the pedestal is approximately 1.5 inches in diameter near the base and approximately one inch in diameter near the top.

5. The ant resistant table of claim 1, wherein the base is round and the first moat, the second land, and the second moat have shapes of concentric rings.

6. The ant resistant table of claim 1, further including a first land between the outside edge of the base and the first moat, wherein the first land, the first moat, and the second land have approximately the same width.

7. The ant resistant table of claim 6, wherein the first land, the first moat and the second land, are approximately ⅜ inches wide.

8. The ant resistant table of claim 1, wherein the second moat is wider than the first moat.

9. The ant resistant table of claim 1, further including a first land between the outer edge of the base and the first moat and a third land between the second moat and the vertical support portion, wherein:

the second land is approximately ⅛ inches above the first land, and the third land is approximately ⅛ inches above the second land.

10. The ant resistant table of claim 9, wherein:

the first land is approximately ½ inches above the base bottom;

the second land is approximately ⅝ inches above the base bottom, and the third land is approximately ¾ inches above the base bottom.

11. The ant resistant table of claim 10, wherein the first and second lands and the first and second moats are approximately ⅜ inches wide.

12. The ant resistant table of claim 1, further including:

a first land residing on the horizontal top surface portion between the outside edge of the base and the first moat;

a third land residing on the horizontal top surface portion between the second moat and the vertical support portion and forming a closed path containing the vertical support portion; and a third moat containing the liquid and residing in the horizontal top surface portion and spaced in from the first land and forming a closed path containing the vertical support portion.

13. The ant resistant table of claim 12, wherein the lands and the moats are each approximately ⅜ inches wide.

14. The ant resistant table of claim 1, wherein the liquid is water.

15. The ant resistant table of claim 1, wherein the liquid is a water and dish soap mixture.

16. An ant resistant table comprising:

a table top for carrying dessert;

a base below the table top, the base having a base bottom for residing on a horizontal surface;

an outer edge of the base;

a vertical support portion of the base providing support to the table top;

a horizontal top surface portion of the base between the outer edge and the vertical support portion and forming a closed path containing the vertical support portion;

a joint obstacle residing on the horizontal top surface between the outer edge and the vertical support portion, the joint obstacle comprising:

a first land residing in the horizontal top surface portion and against the outer edge and forming a closed path containing the vertical support portion and having a width of approximately ⅜ inches;

a first moat containing a liquid and residing in the horizontal top surface portion and inside and against the first land and forming a closed path containing the vertical support portion and having a width of approximately ⅜ inches;

a second land residing on the horizontal top surface portion inside and against the first moat and forming a closed path containing the vertical support portion and having a width of approximately ⅜ inches; and a second moat containing a liquid and residing in the horizontal top surface portion and inside and against the second land and forming a closed path containing the vertical support portion and having a width of approximately ⅜ inches, wherein, the joint obstacle comprising the combination of the first moat, the first land, and the second moat, and the joint obstacle causes the ant to reject a path across the second moat.

17. An ant resistant pedestal serving plate comprising:

a table top for carrying dessert and having a diameter of approximately ten inches;

a base below the table top and having a diameter of approximately six inches, the base having a base bottom for residing on a horizontal surface;

an outer edge of the base;

a vertical support portion of the base providing support to the table top;

a horizontal top surface portion of the base between the outer edge and the vertical support portion and forming a closed path containing the vertical support portion;

a pedestal extending upward from the vertical support portion of the base and vertically supporting the table top approximately six inches above the horizontal surface and being approximately 1.5 inches in diameter near the base and approximately one inch in diameter near the table top;

a joint obstacle residing on the horizontal top surface between the outer edge and the vertical support portion, the joint obstacle comprising:

a first land residing in the horizontal top surface portion and against the outer edge and forming a closed path containing the vertical support portion and having a width of approximately ⅜ inches;

a first moat containing a liquid and residing in the horizontal top surface portion and inside and against the first land and forming a closed path containing the vertical support portion and having a width of approximately ⅜ inches;

a second land residing on the horizontal top surface portion inside and against the first moat and forming a closed path containing the vertical support portion and having a width of approximately ⅜ inches; and a second moat containing a liquid and residing in the horizontal top surface portion and inside and against the second land and forming a closed path containing the vertical support portion and having a width of approximately ⅜ inches, wherein, the joint obstacle comprising the combination of the first moat, the first land, and the second moat, and the joint obstacle causes the ant to reject a path across the second moat.

* * * * *